US005346196A

United States Patent [19]

Nussbaum et al.

[11] Patent Number: 5,346,196

[45] Date of Patent: Sep. 13, 1994

[54] CYCLE BINDING LINE WITH SIGNATURE REPLACEMENT INDICATOR MEANS

[75] Inventors: William E. Nussbaum, Chevy Chase, Md.; Michael J. Armstrong, Arlington, Va.

[73] Assignee: U.S. News & World Report, L.P., Washington, D.C.

[21] Appl. No.: 26,801

[22] Filed: Mar. 5, 1993

[51] Int. Cl.[5] ..... B65H 39/02

[52] U.S. Cl. ..... 270/54; 270/58

[58] Field of Search ..... 270/54, 55, 58

[56] References Cited

U.S. PATENT DOCUMENTS

| | | | |
|---|---|---|---|
| 3,608,893 | 9/1971 | McCain et al. | 270/56 X |
| 3,809,385 | 5/1974 | Rana | 270/54 |
| 3,917,252 | 11/1975 | Harder et al. | 270/58 |
| 3,924,846 | 12/1975 | Reed . | |
| 4,121,818 | 10/1978 | Riley et al. | 270/54 |
| 4,149,711 | 4/1979 | Jackson . | |
| 4,482,142 | 11/1984 | McCain et al. . | |
| 4,789,147 | 12/1988 | Berger et al. . | |
| 5,106,068 | 4/1992 | Honegger . | |
| 5,114,128 | 5/1992 | Harris, Jr. et al. . | |

*Primary Examiner*—Edward K. Look
*Assistant Examiner*—John Ryznic
*Attorney, Agent, or Firm*—Banner, Birch, McKie & Beckett

[57] ABSTRACT

This invention relates to a continuous cycle process for the assembly of an unlimited number of multiple distinct editions of magazines in a bindery line. The invention provides a process wherein signatures in a hopper can be changed to produce a different edition of a magazine without stopping the bindery line. The number of different editions which can be produced without stopping the bindery line is increased without lengthening the line.

7 Claims, 2 Drawing Sheets

CYCLE BINDING LINE WITH SIGNATURE REPLACEMENT INDICATOR MEANS

BACKGROUND OF THE INVENTION

This invention relates broadly to the production of print media such as magazines, books, catalogs and the like. More specifically, the invention relates to a continuous cycle process for the efficient production of multiple different editions of a magazine.

For purposes of this disclosure, reference will hereinafter be made to "magazine" or "magazines" with the understanding that the term is to be considered generic to magazines, books, catalogs and the like.

In a typical magazine assembly system, either a saddle stitch (also known as a saddle wire or inserter binder) or perfect binding (also known as patent, square back, or, in one variation, as side wire binding) bindery line is employed. On a saddle stitch bindery line, preprinted signatures are deposited in proper sequence on a bindery chain conveyor which carries the signatures to a series of processing stations for functions such as calipering, rejection, stitching, trimming, and labeling. Individual signatures are introduced onto the chain from hoppers usually located above and to one side of the chain. Each hopper has a stack of identical signatures. Each signature generally comprises a folded sheet of paper, or a preassembled group of sheets, which will be supported on the bindery chain along a center fold line. Each signature generally comprises four or more printed pages in the finished magazine. For standard magazine production, i.e., where all magazines assembled on the bindery line are identical, each hopper deposits its respective signature onto the bindery chain, as each copy of the magazine being assembled passes by on the chain underneath.

On a perfect binding line the process is similar. The primary differences are that each hopper deposits its respective signature flat onto a moving belt conveyor rather than hanging them onto a moving chain conveyor, so that the signatures are assembled in a side-by-side fashion adjacent to the other signatures rather than in a nested fashion within the other signatures. The signatures and covers are bound together with glue rather than wire staples.

The present invention is broadly applicable to both the saddled stitch and perfect bindery processes. The specific descriptions used as examples herein will focus on the more common saddle stitch bindery process.

It is often desirable to customize each magazine by including or excluding certain signatures based on known characteristics of the recipient. For example, a signature containing articles or advertising relating to women's apparel might be included in those magazines addressed to female recipients and excluded from those magazines addressed to male recipients. Customization of this type is currently a widespread practice in the print media field, and is generally known as selective binding. Selective binding is a technique for intermittently (or "selectively") activating a hopper (or other device, such as a card feeder) on a bindery line according to the edition makeup of the copies in that portion of the bindery run. The edition makeup defines what signatures should be in each edition of the magazine. In selective binding, the various hoppers are fired selectively in accordance with a master control program.

Customizing different editions of a magazine using selective binding techniques is well-known. Such known techniques are disclosed, for example in U.S. Pat. Nos. 3,608,893; 3,917,252; and 4,121,818. Customized editions may be prepared, for example, according to geographic groupings or demographic groupings, such as by income, occupation, gender, other criteria. As explained in the above cited patents, a customized magazine is assembled using a number of common pages or signatures, and a number of customized signatures. The signatures are contained in bins or hoppers which are selectively actuated to produce a specific customized edition.

The number of customized editions which can be conveniently produced without stopping the bindery line is limited by the number of hoppers available to contain the customized signatures. Typically a saddle stitch bindery line will have no more than approximately 20 hoppers. Generally, most of these hoppers will be used for common signatures. The number of hoppers available for the customized signatures is thus very limited. Some magazines may have from 30–700 different regional or demographic editions.

In the known selective binding processes, all the customized or variable signatures for each of the different editions must be available on the bindery line in one of the hoppers during the run sequence, since each of the different editions are produced in random fashion, generally according to postal sortation rules. For example, in a simple four edition magazine, wherein men get one version and women get a different version, and persons under 30 get a version different from persons over 30, the different versions are randomly produced. In this example, at least four separate hoppers containing the variable signatures must be available if, without stopping the bindery line, the different version are produced using selective binding techniques. Thus, for example, if one wants to change signatures for each of six different cities, six selective hoppers would be required for that part of the bindery run. When there are many changes during a bindery run, there may not be enough hoppers available to accommodate all those changes to bind them selectively. Thus, using known techniques, the bindery line must stop, and the needed additional signatures are placed in the bindery hoppers. This is very inefficient, particularly in complex situations with several hundred changes during the bindery run. A "bindery run" is generally defined as the interval between stops in the production on a bindery line necessitated by the specifications of the job or the limitations of the bindery equipment.

Although theoretically the number of hoppers on a bindery could be increased to accommodate all the different editions, this too is not practical or cost-effective. A bindery line having 50 or more hoppers would be excessively long and would significantly slow down the production process. Based on commonly used equipment, each additional hopper degrades production speed by about 250 magazines per hour.

SUMMARY OF THE INVENTION

This invention relates to a continuous cycle process for the efficient assembly of multiple distinct editions of magazines in a bindery line. Binding magazines using the continuous cycle of the invention is referred to as "cycle binding", as opposed to selective binding. Cycle binding includes changing the signatures in a hopper from one form to another without stopping the bindery line. The process generally requires that at least two hoppers be dedicated to the procedure. However, in one variation, the invention may be used with a single hopper turned on or off for a period of time.

Using cycle binding, generally two or more hoppers are made ready with different signatures. The different signatures are typically placed in approximately the same location (known as a "drop") in the magazine. The first hopper feeds the first signature until a controller, recognizing from an encoded signal that the first signature is no longer needed, signals the hopper feeding the first signature to shut down. Simultaneously, the controller signals the second hopper to start feeding. The person feeding the first hopper is signaled to remove the first signatures in the first hopper, and replace it with different signatures. When the second hopper is finished (again, determined by an encoded signal), it is turned off and the first hopper (now, with a different signature) is automatically restarted. The advantage over manual *changing on the fly* is that the change from one form to another happens with great precision and control, and without stopping the line—even for an instant.

For cycle binding to work, the magazines must be organized into processing groups. For each processing group, known hopper mapping techniques and a bindery controller determine and control which hoppers or sets of hoppers should be activated or be made available. This organization is preferably done by presorting information from the mailing file typically used to properly address the magazines. The production of the magazine moves, serially, from one processing group to another, until the bindery run is complete. Care must be taken to ensure that groups are not so small that operators cannot keep up with the required changes.

The invention provides a continuous processing wherein an unlimited number of different magazine editions can be produced without stopping the bindery line. The invention also provides for a system for reusing or recycling hoppers by allowing signatures in a hopper to be changed without stopping the bindery line. Using the invention, the total number of hoppers in the bindery line can be less than the total number of different editions to be produced on the line. The process of the invention thus is accomplished without an extended bindery line and without stopping, and is faster and more efficient than known processes using selective binding techniques. According to the invention, the effective capacity of the bindery line is increased without lengthening the line.

The invention comprises the steps of first organizing each different edition into a processing group. In the preferred form of the invention, this is done by a controller tape with digital information on it concerning each of the different editions. Codes are put into the tape that will provide signals to the hoppers. The codes determine which of the hoppers containing the customized or variable signatures will be activated.

The codes define and create groups of magazines with specific characteristics. Magazines in each group may be made up of some combination of signatures common to all of the copies within the group, some signatures from hoppers fired selectively, and some signatures from hoppers designed to cycle from one signature to another without stopping. A hopper used for selective binding may also be used for cycle binding. Signatures fed from a hopper that is firing selectively may be removed and the hopper can then be used in the cycle binding process that is the subject of this invention. There is no physical difference in the hoppers. Thus, the invention allows complete flexibility in hopper mapping, and the combined or alternative use of traditional, selective, and cycle binding techniques on the same bindery line. A controller, such as a computer as well-known in the technology, provides the controls for the bindery process.

The hoppers adapted for cycle binding contain a switch activated by codes to either fire, or (in the case of a hopper designated for intermittent firing for special demographic selections within a series) make ready to fire according to the requirements of the designated group. One or more hoppers may simultaneously be initiated (or made available for firing) and then switched off in this manner.

The operation of producing each different edition is continuous. There is no need to stop the processing to change signatures in a particular hopper for a different edition of the magazine. Using the present invention, without stopping, it is possible to produce an unlimited number of different editions in a continuous process with only a limited number of hoppers. Moreover, it is possible to significantly increase the processing speed by using shorter bindery lines, since fewer hoppers are needed because the hoppers can be continually recycled or reused for more than one set of signatures.

According to the process of the invention, each of the common signatures, which are common to all editions and to all processing groups, are placed into their respective common hoppers. A first set of one or more of the variable signatures, which differ for each different edition and for each processing group, also are placed into their respective one or more variable or cycle hoppers. If both selective signatures and variable signatures are used within a particular edition, the selective signatures would be placed in hoppers which are selectively activated according to well-known techniques. The process of assigning signatures to hoppers is done according to well-known hopper mapping techniques.

The hoppers containing the common signatures are, of course, activated at all times to thereby feed signatures from the common hoppers onto the conveyor. If selective signatures also are used, the hoppers containing them are activated as appropriate. The hoppers containing the variable signatures are activated in response to a signal, such as, in the preferred form of the invention, a signal generated from the control codes in the bindery controller. This signal activates those variable hoppers containing the signatures for the first edition and the first processing group to thereby feed signatures from these variable hoppers onto the conveyor. The variable hoppers containing signatures not included in the first processing group will not be activated at this time.

The first processing group is processed until it has been completed. At the end of the first processing group, the bindery controller signals the variable hoppers in the first processing group to be turned off, and signals the variable hoppers in the second or next processing group to be turned on. This process is continuous. There is no delay or break between the processing groups. The second processing group is then processed until it is completed.

The variable hoppers are usually recycled and used for more than one processing group. Thus, at the completion of the first processing group, any variable signatures which may be left over in the variable hoppers used for the first processing group are removed. The variable signatures for a later processing group are inserted. The signatures placed into the first or other set of variable hoppers at the completion of the processing group using those hoppers is dependent on the number of different processing groups and the hopper mapping for the bindery line.

As each edition and processing group is completed, the signatures in the variable hoppers used for that processing group are replaced with the signatures for a later processing group. This process is continued until all the editions are completed. In this manner, the processing between editions is a continuous cycle. There is no need to stop the bindery line at any time to change signatures for different editions.

In the preferred form of the invention, the invention further includes the step of signaling an operator when each of the different processing groups have been completed. Preferably, this includes providing a visual signal, such as a light, which will also indicate which of the variable hoppers were activated for the completed processing group and thus are now available to be reloaded with signatures for a future processing group.

DETAILED DESCRIPTION OF THE INVENTION

Figure 1:
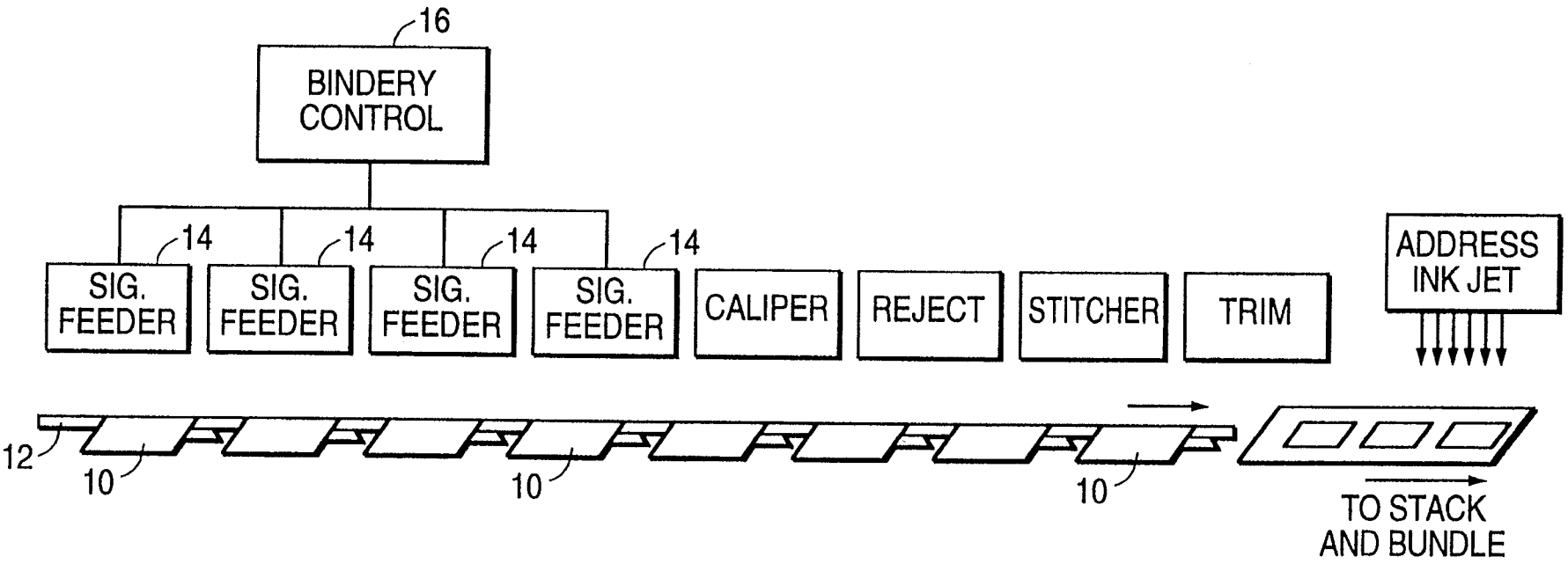
FIG. 1 is a schematic illustration of a typical bindery line.

The present invention is a continuous cycle process for the production of multiple different editions of a magazine. The invention uses standard binding equipment as is well-known and commonly used in the industry. Although the invention can be used with either a saddle stitch binder or a perfect binder, the preferred form of the invention will be described generally with respect to a saddle stitch binder. It will be appreciated that the invention applies equally to other types of binding wherein pages of the magazine to be bound are deposited on a bindery line from bins or hoppers in a particular sequence.

In a typical saddle stitch bindery line, signatures 10 are deposited in a predetermined sequence on a chain conveyor 12. A "signature" is a standard industry term and simply refers to a preprinted, folded paper which will form at least four pages of the magazine. The signature is supported on the chain conveyor along its center fold line. The chain conveyor 12 runs beneath a series of signature feeders or hoppers 14 which contain the signatures and feed them to the chain conveyor. A card feeder which feeds forms, or similar device for depositing items to be bound on a bindery line, may also be used rather than signature feeders or hoppers 14. Although only four hoppers are shown in the simplified schematic of FIG. 1, a typical bindery line will have approximately 20 hoppers. Increasing the number of hoppers significantly beyond 20 increases the cost of the bindery line and decreases the production speed of the bindery line to commercially unacceptable levels. Thus, the length of the bindery line limits the number of editions which can be produced efficiently. The present invention overcomes this problem and allows an unlimited number of different editions to be efficiently produced using a standard bindery line with less than 20 hoppers.

As shown in FIG. 1, a typical bindery line also includes a caliper station, a reject station, a stitcher station, a trim station, and an address station. After the signatures are assembled, stitched, trimmed and addressed, they proceed to be stacked and bundled for shipping and mailing. These additional stations are well-known in the technology and do not form a part of the present invention. They are illustrated in FIG. 1 to show the context of the present invention.

In a conventional bindery process, as the chain conveyor 12 moves beneath each hopper 14, a computer controlled system 16 determines whether a signature from that hopper will be activated and thus deposited in sequence on the chain conveyor 12. For example, if the first hopper 14 contains signatures for magazines being mailed to women, and the magazine being produced is not being mailed to a woman, the first hopper would not be activated. If the next magazine is being mailed to a woman, the first hopper would be activated. This is representative of the operation of a typical selective binding process. Signatures are selectively deposited on the conveyor chain according to the content of a particular edition of the magazine being produced. As the conveyor chain moves beneath each hopper, the hopper is either activated or not activated according to the particular edition of the magazine being produced.

According to the process of the present invention, however, each bindery run segment is first organized into a processing groups with a specified edition makeup. This edition makeup will consist of no more than one regional edition (defined by material designated for all readers within the area served by the processing group) and possibly one or more demographic versions of that regional edition. Thus, regional edition number one and any demographic versions of regional edition number one will be organized into a first processing group; regional edition number two and any demographic versions of edition number two will be organized into a second processing group. All of the magazines in the first processing group will be produced first. When all of the first edition magazines in the first processing group are completed, the magazines in the second processing group will be processed. This process continues until all the different processing groups, corresponding to all the different editions, have been processed. When the magazines in the processing groups are sorted for mailing, the sortation programs which qualify the mailing for presort discounts must be adjusted to avoid interrupting the continuity within a processing group.

In the preferred form of the invention, organizing each edition into a processing group is done by a controller tape with digital information on it concerning each of the different editions, shown generally as part of the bindery control 16. Codes are put into the tape that will provide signals to the hoppers on the binding machine. The codes determine which of the hoppers containing the customized or variable signatures will be activated. The codes also define and create a homogeneous series or grouping of magazines, such as a regionally homogeneous grouping. Within each series or grouping, all the magazines produced will be the same except for those incorporating signatures using selective binding technology.

The hoppers all contain a switch which is activated by the signals provided by the codes. The switch turns the hoppers on or off, to either feed or not feed signatures in that hopper.

Figure 2:
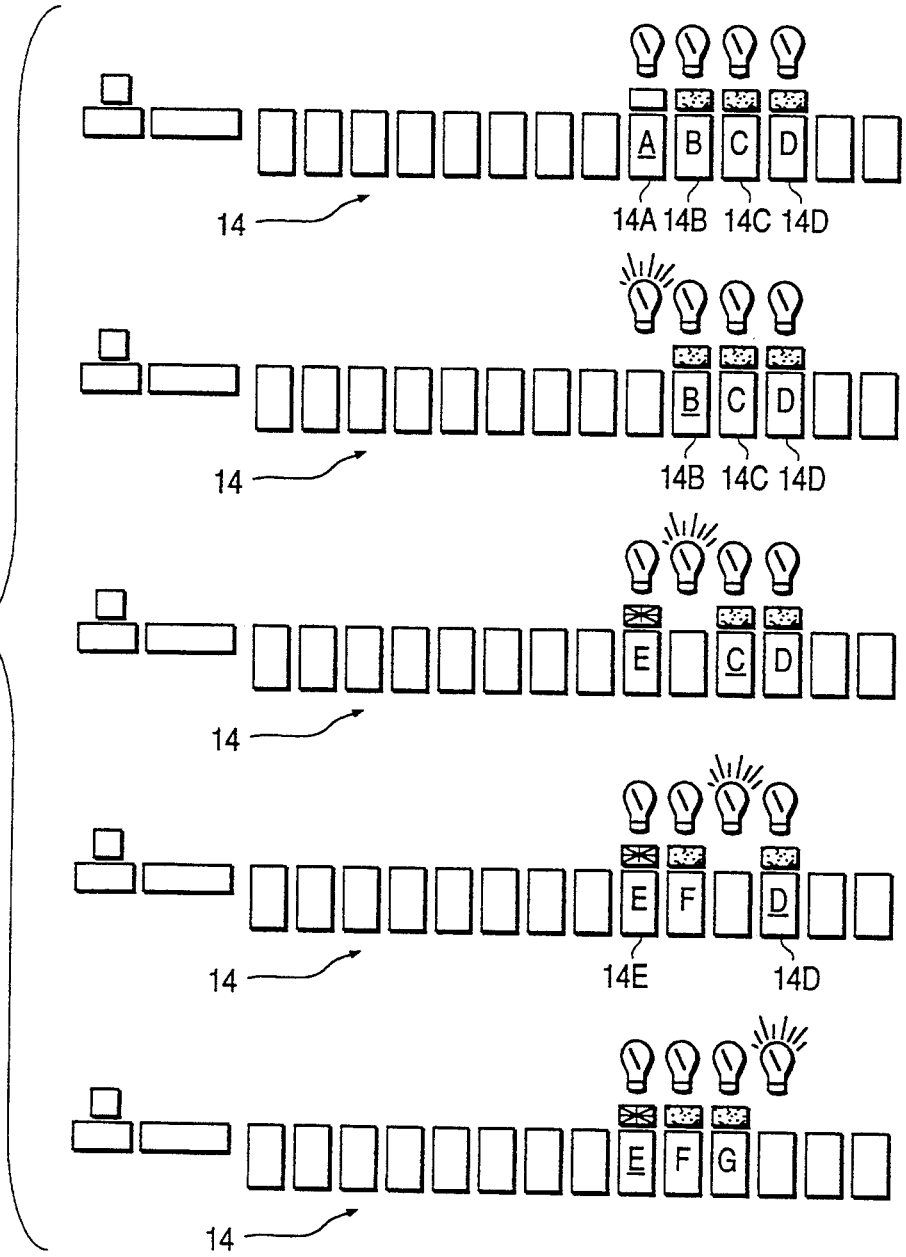
FIG. 2 is a schematic representation of the hoppers in a bindery line as they would function according to the present invention.

As shown in the schematic illustration of FIG. 2, the bindery line contains a plurality of hoppers 14. In the example shown, the unlabeled hoppers 14 contain signatures common to all editions of the magazine. Thus, for all editions, these hoppers will be activated as the conveyor chain 12 passes beneath them. Hoppers 14A–14D contain variable signatures, each of which will be used in only one group. It of course will be appreciated that the allocation of hoppers to common or variable signatures, commonly referred to as hopper mapping, is dependant on the content of the magazine edition being produced, the number of hoppers available, and a number of other factors which are not part of the present invention. The specific example shown in FIG. 2 is a very simple example wherein there is only one variable signature for each different edition. This specific example is provided to provide a description of the invention, and not to limit the invention.

The processing of the different editions has been organized into the corresponding different processing groups. For the first processing group, as the conveyor chain 12 proceeds under the unlabeled hoppers 14 each hopper is activated in known fashion to deposit the signature contained in that hopper onto the conveyor chain. In this specific example, for the first edition of the magazine, the magazine will receive the signature in hopper 14A, but will not receive the signatures in hoppers 14B–14D. Thus, according to the controller tape codes, hopper 14A will be activated to deposit the signature from that hopper onto the conveyor chain. Hoppers 14B–14D will not be activated. Similarly, the second edition of the magazine will receive the signatures in hopper 14B, but not 14A or 14C–14D. The other editions will be processed similarly. For the specific example, there will be more than four different editions.

All of the magazines in the first processing group are processed together, each receiving a signature from hopper 14A and not from hoppers 14B–14D. When all of the magazines in the first processing group have been completed, the controller tape codes deactivate hopper 14A and activate hopper 14B, which contains signatures for the second processing group, corresponding to the second edition. Hoppers 14C and 14D are also deactivated in this specific example. The process of shifting from one processing group to another is continuous. There is no need to stop the bindery line.

When the controller tape codes shift from hopper 14A to hopper 14B, they also provide a signal to an operator that the first processing group using hopper 14A is completed. In the simple schematic of FIG. 2, this signal has been represented pictorially as a visual signal, such as light bulb. It will of course be recognized that other signals can also be used in the invention.

Upon receiving the signal that the first processing group using hopper has been completed, the operator removes any remaining signatures for the first processing group from hopper 14A and replaces them with signatures for the fifth processing group, such as 14E.

Processing of each different processing group proceeds in similar fashion. Processing group two, using the signatures from hopper 14B, completes its run. The controller tape codes then deactivate hopper 14B and activate hopper 14C, for processing the third processing group. Similarly, a signal is provided for the operator to know that the second processing group, using hopper 14B, has been completed. The operator then removes the signatures for the second processing group from hopper 14B and replaces them with the signatures for the sixth processing group, 14F.

The cycle continues in processing groups C and D. At the conclusion of group C, the signatures in hopper 14C are replaced with those of the seventh processing group, 14G.

At the conclusion of the fourth processing group D, the system automatically activates hopper 14E, containing the signatures for the fifth edition, and formerly containing signatures for the first edition. Again the cycle continues for remaining editions, identified in this example as F and G. By continually changing the signatures in the variable hoppers, it is possible to process as many different editions as needed.

Thus, as shown in this simple example, it is possible to process an unlimited number of different editions using a limited number of hoppers by grouping each edition for batch processing, and by recycling the hoppers.

Although a preferred form of the invention has been described, it is to be understood that this description is for illustrative purposes. The number of different editions, the types of magazines, the bindery process, the number of hoppers, the system for grouping the different editions and the system for controlling the process all can be varied from the specific example provided within the scope of the invention, which is defined by the following claims.

We claim:

1. In a continuous process for the assembly of multiple distinct editions of magazines wherein each edition is composed of common signatures which are common to all editions of the magazine and one or more variable signatures which differ for each different edition of the magazine, and wherein the common signatures are gathered on a collecting device from a plurality of common induction stations containing the common signatures, and wherein the one or more variable signatures are deposited on the collecting device from one or more variable induction points containing the variable signatures, the improvement comprising the steps of:

(a) organizing each different edition into homogeneous processing groups;

(b) placing each of the common signatures, which are common to all processing groups at their respective common induction points;

(c) placing the variable signatures for at least two of said homogenous processing groups at their respective one or more variable induction points;

(d) activating the common induction points having the common signatures to thereby feed signatures from the common induction points onto the collecting device;

(e) activating the variable induction points having the variable signatures for one of the homogeneous processing groups to thereby feed signatures from these variable induction points onto the collecting device;

(f) processing said one processing group until it has been completed;

(g) deactivating the variable induction points having the variable signatures for said one processing group;

(h) without stopping the assembly process, activating the variable induction points having the variable signatures for a different homogeneous processing group to thereby feed signatures from these variable induction points onto the collecting device;

(i) without stopping the assembly process, placing at the variable induction points for a completed processing group, the variable signatures for another processing group;

(j) processing said processing group from step (h) until it has been completed;

(k) deactivating the variable induction points containing the variable signatures for said processing group from step (h) for which processing has just been completed;

(l) repeating steps (h), (i), (j) and (k) until all processing groups have been completed.

2. The process as claimed in claim 1 further including the step of signaling an operator when each of the different processing groups have been completed.

3. The process as claimed in claim 2 wherein the step of signaling an operator comprises the step of providing a visual signal to the operator.

4. The process as claimed in claim 2 wherein the step of signaling the operator comprises signaling at the completion of each processing group which of the variable hoppers were activated for the completed processing group.

5. A continuous process for the assembly of multiple distinct editions of magazines having a plurality of induction points for gathering signatures, wherein each edition is composed of one or more variable signatures which differ for each different edition of the magazine comprising the steps of:

(a) organizing each different edition into homogeneous processing groups;

(b) placing the variable signatures for a first homogeneous processing group at one or more induction points;

(c) placing the variable signatures for a second homogeneous processing group at one or more induction points;

(d) activating the induction points having the variable signatures for the first homogeneous processing group;

(e) processing the first processing group until it is completed;

(f) when the first processing group has been completed, deactivating the induction points having the variable signatures for the first processing group and, without stopping the the assembly process, activating the induction points having the variable signatures for the second homogeneous processing group;

(e) processing the second processing group until it has been completed;

(f) replacing without stopping the assembly process the signatures in one or more of said induction points containing said variable signatures used in said first processing group when said first processing group has been completed with different variable signatures, and activating the induction points containing said different variable signatures as a processing group.

6. A machine for the assembly of multiple distinct editions of magazines in a continuous assembly process, said machine having a plurality of induction points for gathering signatures, wherein each edition is composed of common signatures which are common to all editions of the magazine and one or more variable signatures which differ for each different edition, the improvement comprising:

(a) means for organizing each different edition into homogeneous processing groups;

(b) a first induction point having the variable signatures for a first homogeneous processing group;

(c) a second induction point having the variable signatures for a second homogeneous processing group;

(d) means for activating the induction points having the variable signatures for the first homogeneous processing group;

(e) means for deactivating the induction points having the variable signatures for the first processing group when the first processing group has been completed and, without stopping the assembly process, means for activating the induction points having the variable signatures for the second homogeneous processing group;

(f) means for replacing without stopping the assembly process the variable signatures at the first induction point with signatures of a processing group different from the signatures of the first processing group.

7. A controller for a continuous process for the assembly of multiple distinct editions of magazines wherein each edition is composed of common signatures which are common to all editions of the magazine and one or more variable signatures which differ for each different edition of the magazine, and wherein the common signatures are gathered on a collecting device from a plurality of common induction points having the common signatures, and wherein the variable signatures are gathered on the collecting device from a plurality of variable induction points having the variable signatures, and wherein the total number of variable induction points is less than the total number of different editions, the controller comprising:

(a) control means for activating the common induction points having the common signatures to thereby feed signatures from the common induction points onto the collecting device;

(b) control means for activating one or more variable induction points having the variable signatures for one homogeneous processing group to thereby feed signatures from these variable induction points onto the collecting device;

(c) control means for deactivating the variable induction points having the variable signatures for said one processing group when that processing group has been completed;

(d) control means for activating one or more variable induction points having the variable signatures for a different homogeneous processing group to thereby feed signatures from these variable induction points onto the collecting device when said one processing group has been completed; and (e) control means for deactivating the variable induction points having the variable signatures for said different processing group when said different processing group has been completed;

(f) control means for reactivating without stopping the assembly process the one or more variable induction points having the variable signatures for one homogeneous processing group after the variable signatures of one processing group has been completed and replaced with variable signatures of a processing group different from the signatures of the first homogeneous processing group.

* * * * *